US009179724B1

(12) United States Patent
Schultz et al.

(10) Patent No.: US 9,179,724 B1
(45) Date of Patent: Nov. 10, 2015

(54) BEVERAGE DISPENSING HEADWEAR

(71) Applicants: Troy Schultz, Highlands Ranch, CO (US); Neil James Rooney, Highlands Ranch, CO (US)

(72) Inventors: Troy Schultz, Highlands Ranch, CO (US); Neil James Rooney, Highlands Ranch, CO (US)

( * ) Notice: Subject to any disclaimer, the term of this patent is extended or adjusted under 35 U.S.C. 154(b) by 0 days.

(21) Appl. No.: 14/169,924

(22) Filed: Jan. 31, 2014

(51) Int. Cl.
*A42B 1/24* (2006.01)
*A42B 1/00* (2006.01)

(52) U.S. Cl.
CPC .. *A42B 1/006* (2013.01); *A42B 1/24* (2013.01)

(58) Field of Classification Search
CPC ..... A42B 3/048; A42B 1/24; B67D 2210/00131; B67D 3/00
USPC ..... 2/209.13; 222/175; 224/148.1–148.4, 224/148.7
See application file for complete search history.

(56) References Cited

U.S. PATENT DOCUMENTS

| | | | | |
|---|---|---|---|---|
| 340,793 | A | | 4/1886 | Leonard |
| 770,031 | A | | 9/1904 | Werrick |
| 2,335,630 | A | * | 11/1943 | Bachardy ..... 2/7 |
| 3,068,865 | A | * | 12/1962 | Laszlo ..... 128/200.28 |
| 3,070,803 | A | * | 1/1963 | Slepicka ..... 2/7 |
| 4,356,709 | A | | 11/1982 | Alexander |
| D267,208 | S | * | 12/1982 | Denison ..... D2/871 |
| 4,551,858 | A | | 11/1985 | Pasternack |
| 4,681,244 | A | | 7/1987 | Geddie |
| 4,739,905 | A | | 4/1988 | Nelson |
| 4,813,083 | A | | 3/1989 | Davidson |
| 4,921,141 | A | | 5/1990 | Branum |
| 5,148,950 | A | | 9/1992 | Hosaka |
| 5,325,539 | A | | 7/1994 | Kronenberger |
| 5,340,006 | A | | 8/1994 | Li |
| 5,966,743 | A | | 10/1999 | Flann |
| 5,970,523 | A | | 10/1999 | Atkins |
| 6,105,827 | A | | 8/2000 | Rowan |
| 6,125,474 | A | | 10/2000 | Gillette |
| 7,007,502 | B2 | | 3/2006 | Kreutzmann et al. |
| 2006/0005291 | A1 | | 1/2006 | Bedford |
| 2013/0247271 | A1 | | 9/2013 | Bowen et al. |

FOREIGN PATENT DOCUMENTS

| | | |
|---|---|---|
| WO | WO2008129514 | 10/2008 |

* cited by examiner

*Primary Examiner* — Anna Kinsaul
(74) *Attorney, Agent, or Firm* — Ramon L. Pizarro; Edwin H. Crabtree

(57) ABSTRACT

A wearable sombrero-style hat with a refillable reservoir is disclosed. The sombrero-style, or type, hat has a generally conical crown with an opening at the top of the conical crown. The opening allows the use of a reservoir that is adapted for insertion through the opening in the conical crown. The reservoir also includes an upper end with a fill neck that has a cantilevered collar or protrusion that extend from the fill neck in a generally radial manner. The collar or protrusions engages the edge of the edge of the opening at the top of the generally conical crown to support the fill neck at or near the top of the conical crown, while the lower end and outlet of the reservoir are positioned below the fill neck, and thus allow the connection of a dispensing tube to the outlet of the reservoir, and thus allow the user to drink from the reservoir through the dispensing tube.

1 Claim, 2 Drawing Sheets

BEVERAGE DISPENSING HEADWEAR

BACKGROUND OF THE INVENTION (a) Field of the Invention

This application relates to headgear that includes a bladder or reservoir for storing and dispensing a beverage, and to a method for making such a device from known hats that have a high conical crown.

(b) Discussion of Known Art

The use of headgear to store liquids or beverages is known. Examples of known devices include U.S. Pat. No. 5,970,523 to Atkins, which teaches the use of a baseball cap that has an inner layer and outer layer defining a reservoir for holding a liquid. The Atkins device also includes a headband that supports the reservoir at a distance from the wearer's head, and thus avoids direct contact of the reservoir and the wearer's head. Liquids stored in the reservoir are likely to be colder than the wearer's body temperature, and thus the spacing prevents heat transfer from the wearer to the liquid.

An important limitation of the Atkins device is that the entire hat structure must be specially made from impermeable material. This increases manufacturing and material costs. Additionally, the shape of the hat itself resembles the well-known baseball cap, and therefore does not provide clues as to its unconventional nature and do not provide substantial protection from the sun.

A review of known devices reveals several hats that hold beverages and serve as a novelty item for festive occasions. Examples of hats that have provide these benefits can be found in U.S. Pat. No. 6,105,827 to Rowan, and U.S. Pat. No. 4,681,244 to Geddie. However, these devices must be supported from a rigid hat, such as a hard hat, which provides significant weight and very little protection from the sun.

Accordingly, there remains a need for a simple device for holding beverages that also functions as a hat, providing protection to the wearer against the sun, and method for creating such a device.

SUMMARY

It has been discovered that using a "sombrero" type hat (which are often of woven straw) 38 with an internal reservoir for holding fluids can solve the problems left unanswered by known art. A preferred example of the disclosed invention includes:

A sombrero hat having a large brim and a generally conical crown, the generally conical crown having a top and a base, the base being attached to the brim, and the top having an opening having an edge, so that the generally conical crown does not terminate at a point, but is truncated so as to provide the opening at the top;

A reservoir that is adapted for insertion into the conical crown, the reservoir having an upper end with a fill neck that is adapted for cooperating with a cap that closes off the reservoir, the fill neck having a cantilevered collar or protrusion that extend from the fill neck in a generally radial manner, the collar or protrusions are adapted for engaging the edge of the aperture at the top of the generally conical crown, the reservoir further having a lower end with an outlet, so that the lower end and its outlet are positioned below the fill neck when the collar or protrusions engage the aperture at the top of the generally conical crown.

According to a highly preferred embodiment of the invention, the reservoir is also supported against the interior surface of the generally conical crown. This helps support the reservoir while full of liquid. It is contemplated that the reservoir will be of a flexible material, so that the reservoir may simply collapse as liquid is drawn from the reservoir. It is contemplated that the support of the reservoir will be through the use of a reusable-adhesive, such as hook and loop material that is positioned on opposite sides of the reservoir, in order to allow the reservoir to collapse as liquid is dispensed, while at the same time supporting the reservoir.

It is contemplated that a reservoir dispensing tubing will be connected to the lower end of the reservoir. According to a preferred example of the invention, the reservoir dispensing tube will incorporate an elbow or will attach to an "L" shaped duct that will allow the connection of a flexible dispensing tube that will extend from the elbow or the "L" shaped duct. The flexible dispensing tube may then be routed through the side of the conical crown and then through the brim of the sombrero, so that it may then reach the user's mouth. It is preferred that a valve be placed at or near the end of the flexible dispensing tube, at or near a location near the dispensing end of the flexible dispensing tube. The valve may be one of many well-known valve devices that open when the user bites down on the valve, or a manually operated device.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
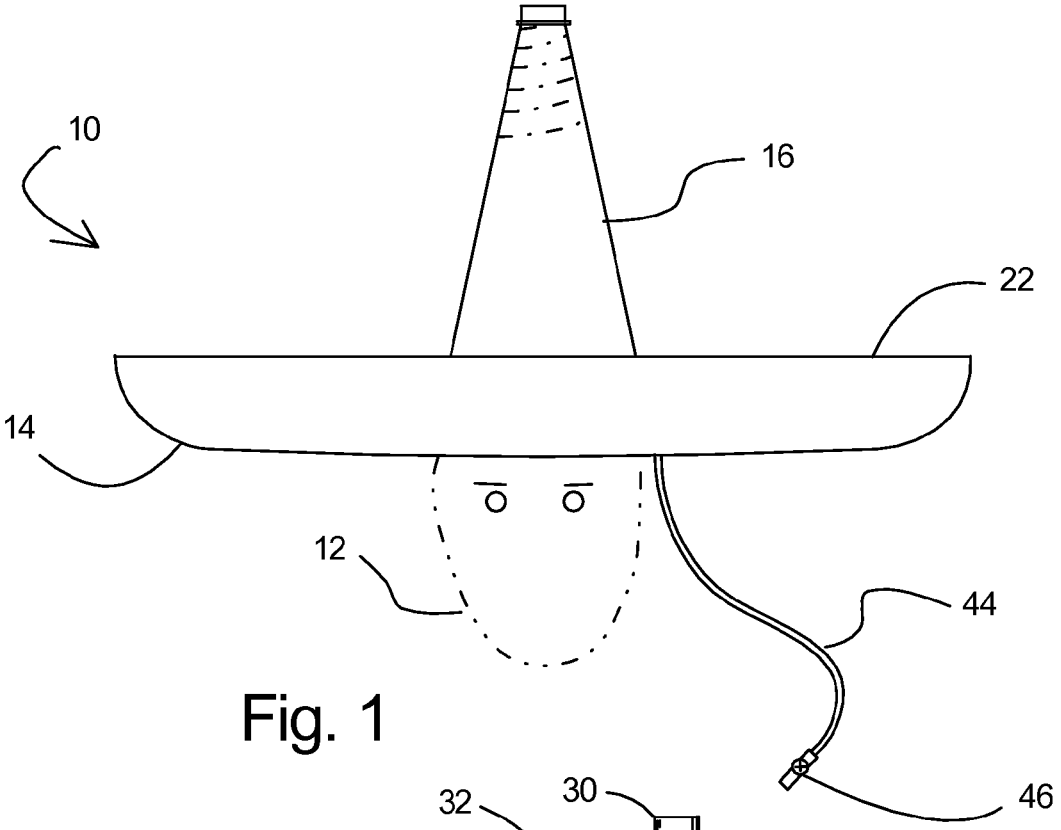
FIG. 1 shows the disclosed invention as worn on a person's head.

Turning now to FIG. 1 where a preferred example of the disclosed headwear 10 while being worn on the head of a person 12. FIG. 1 illustrates that the headwear 10 uses a "sombrero" style hat 14, which has a generally conical crown 16. Additionally, the generally conical crown 16 has a top 18 and a base 20, which is attached to the brim 22 of the sombrero style hat 14. It can be understood from FIG. 1 that a characteristic of the sombrero style hat 14 is that the brim 22 extends over at least about half of the wearer's shoulders 24, and typically over the entirety of each of the wearer's shoulders 24. The top 26 of crown 16 will be truncated and provide an aperture 28, which has been illustrated in FIGS. 3 and 4. The truncated top 26 will give the conical crown a slight generally frustoconical shape, as shown in the accompanying drawings. The frustoconical shape of the conical crown 16 will be topped with a cap 30, which may be cylindrical or conical, so as to provide an overall conical appearance to the crown 16.

Figure 2:
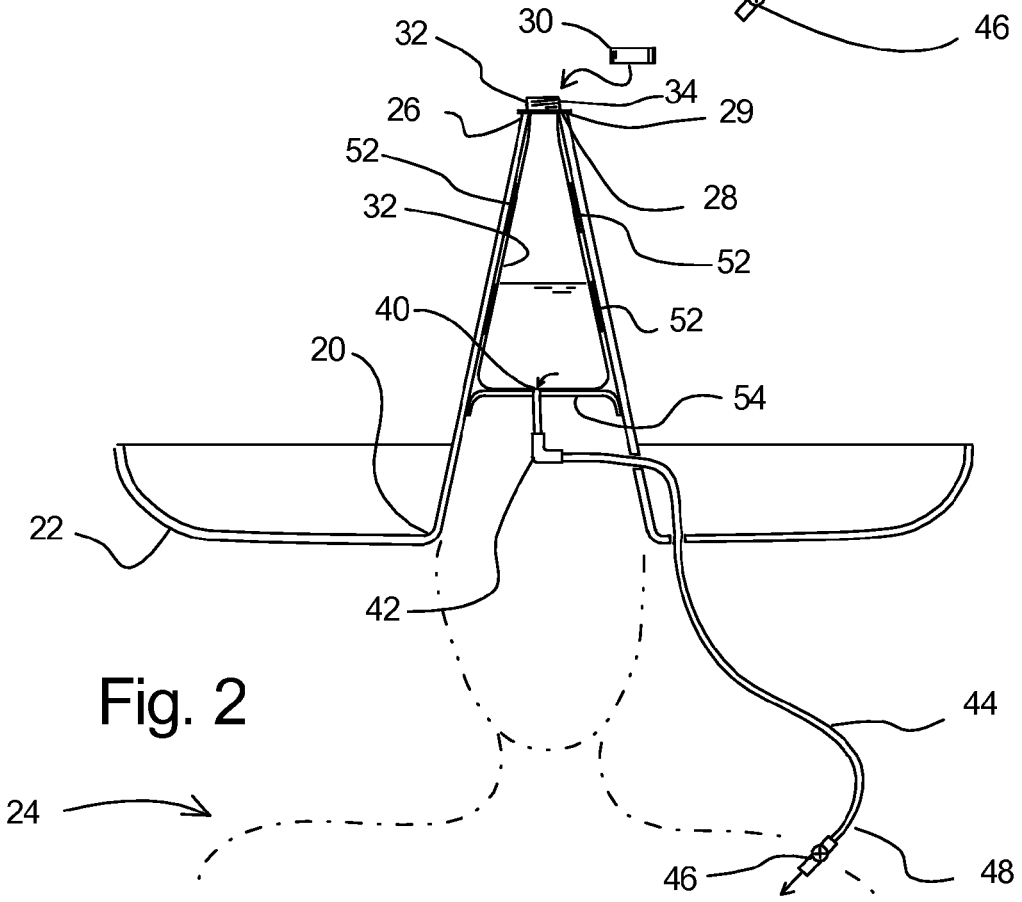
FIG. 2 is a cut-away view of the embodiment illustrated in FIG. 1, and shows an example of the reservoir used with the disclosed invention, the reservoir being generally frustoconical, to match the generally frustoconical shape of the truncated crown of the sombrero hat.
Figures 3, 4:
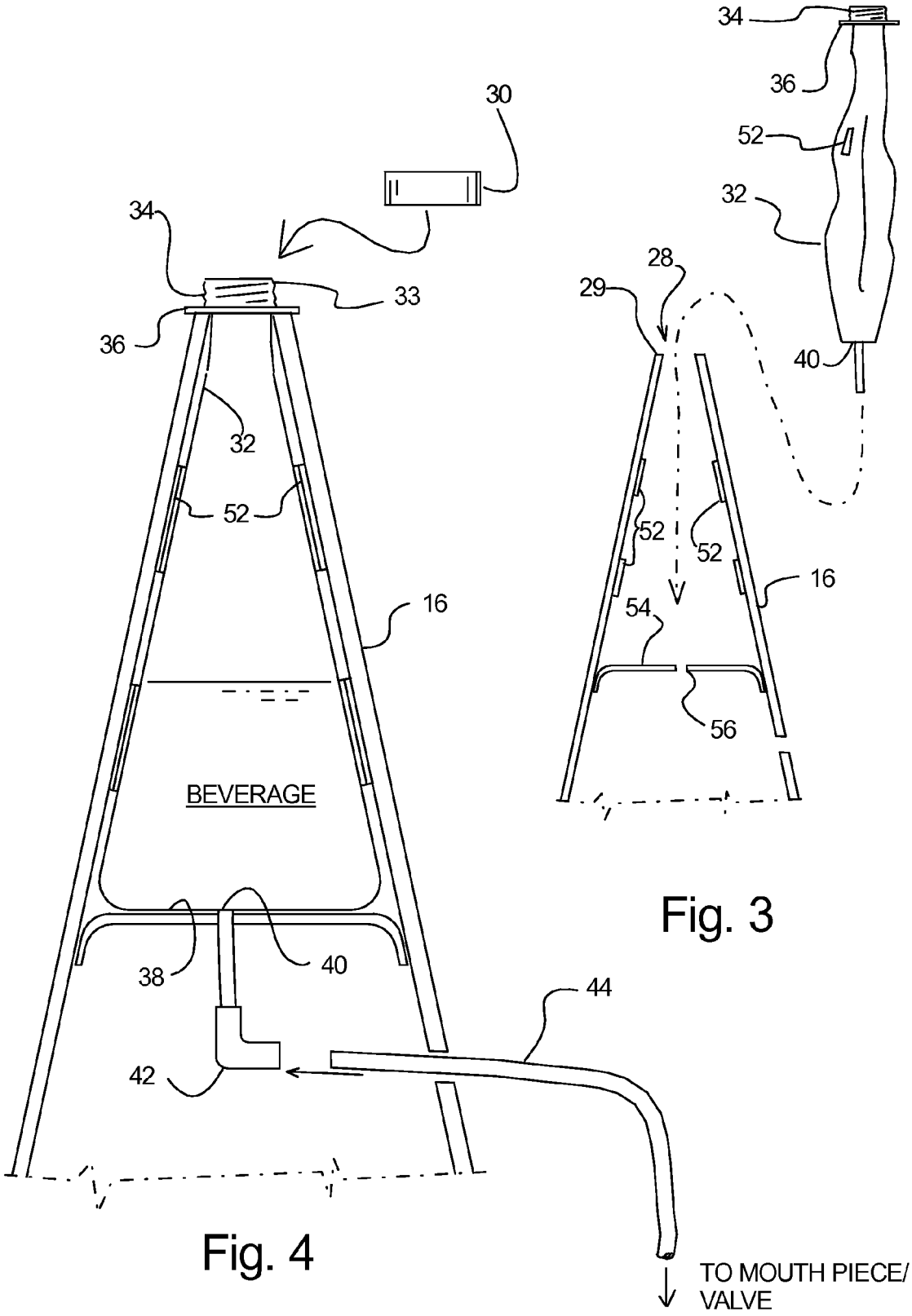
FIG. 3 illustrates the insertion of the collapsed reservoir into the aperture at the top of the crown of the hat used with the disclosed invention.
FIG. 4 is a detailed view of the crown of the hat used with the disclosed invention and the reservoir, support mechanism, and ducting used with the disclosed invention.

Turning now to FIGS. 2 and 3, it will be understood that the disclosed headwear 10 will include a refillable reservoir 32. The refillable reservoir is preferably made from a flexible material that will allow the reservoir 32 to be collapsed as shown in FIG. 3. The collapsibility of the reservoir 32 allows assembly of the disclosed invention by inserting the collapsed reservoir 32 through the aperture 28, with an edge 29, on the top 18 of the crown 16. It should be noted that while it is preferred that the aperture 28 may be made by cutting off, or truncating, the conical crown 16, it is also contemplated that the disclosed invention may be made by making a side aperture on the side of the conical crown 16, and inserting the refillable reservoir through the side aperture. However, this would result in the cap 30 being positioned at a very visible location along the conical crown 16.

FIGS. 3 and 4 also illustrate that the cap 30 will cooperate with a fill neck 33 that preferably includes a threaded portion 34 that allows the cap 30 to be securely attached to the fill neck 33. It should be noted that other mechanism could be used instead of threads to retain the cap 30 against the fill neck 32. Examples of such mechanisms include friction-based devices, such as rubber stoppers or caps with a resilient inner protrusion that fits into a recess or ridge on the fill neck 33.

Also shown on FIGS. 3 and 4 is the use of a cantilevered collar 36 on the fill neck 33. The cantilevered collar 36, or protrusion, extends from the fill neck 36 in a generally radial manner, and thus allows the collar 36 to engage or rest on the edge 29 of the aperture 28 in the generally conical crown 16.

FIG. 4 further illustrates that the reservoir 32 also includes a lower end 38 with an outlet 40. This arrangement allows the lower end 38 and its outlet 40 to be positioned below the fill neck 33 when the collar 36 or protrusions engage the edge 29 of the aperture 28 in the generally conical crown 16. This positions the outlet 40 at a location between the lower end 38 of the reservoir 32 and the brim 22, and inside the conical crown 16. An L-shaped duct 42, or elbow, is attached to the outlet 40, and a dispensing tube 44 is attached to the L-shaped duct 42. The dispensing tube 44 is flexible and of a length that will allow the dispensing tube 44 to reach the user's mouth. A valve 46 is positioned at the end 48 of the dispensing tube 44, or along the dispensing tube. The valve will allow the user to control the flow of fluids from the reservoir 32 towards the end 48 of the dispensing tube 44.

Referring to FIG. 4, it will be understood that according to a highly preferred embodiment of the invention, the reservoir 32 is also supported against the interior surface 50 of the generally conical crown 16 by way of a fastener 52, which is shown as being hook and loop material, but may be a simple hook or other engagement mechanism. This internal support helps distribute the weight of the reservoir while full of liquid.

Additionally, FIGS. 3 and 4 illustrate that the reservoir 32 may be further supported from an internal divider wall 54, which is also attached to the interior surface 50, and which includes a passage 56 that provide access to the outlet 40, and thus allows connection of the outlet 40 to the L-shaped duct 42 or to a dispensing tube. The internal divider wall 54 may be formed from strips of material, insulated, padded, or of any other suitable structure that assists in supporting the reservoir 32 and separate the reservoir 32 from the user's head.

It will also be understood from the above discussion that a method for retrofitting ready-made sombrero-style hats into hats that can hold a reservoir that supplies fluids to the user is also disclosed. The method includes the steps of providing a sombrero-style hat with a generally conical crown, removing a section of the tip of the conical crown to create an aperture in the tip of the conical crown, and then providing a flexible reservoir or bladder with an inlet with a cantilevered collar. Inserting the reservoir through the aperture while the reservoir is collapsed, and then allowing the collar to rest or engage the edge of the aperture at the tip of the conical crown. The reservoir is then allowed to extend down to where the dispensing tube may be engaged to the outlet of the reservoir and allowed to reach the user's mouth. Additional support for the reservoir may be provided as discussed above.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A headwear with a refillable reservoir, the headwear allowing a person to drink from the refillable reservoir while wearing the headwear, the headwear comprising:

a sombrero-type hat having a large brim that is adapted for extending over shoulders of the person, the sombrero-type hat further having a generally conical crown, the generally conical crown having a top and a base, the base being attached to the brim, and the top having an opening at the top, the opening having an edge, so that the generally conical crown does not terminate at a point, but is truncated so as to provide the opening at the top of the conical crown, the conical crown having an internal surface, the internal surface having at least one fastener mounted to the internal surface;

an interior divider wall that extends across the base of the conical crown, the interior divider wall having a passage therethrough;

a flexible reservoir that is adapted for insertion into the opening in the conical crown, the flexible reservoir having an upper end with a fill neck that is adapted for cooperating with a cap that closes off the flexible reservoir, the fill neck having a cantilevered collar or protrusion that extends from the fill neck in a generally radial manner, the collar or protrusion is adapted for engaging the edge of the opening at the top of the generally conical crown, the flexible reservoir further having a lower end with an outlet that is positioned to coincide with the passage through the interior divider wall, the flexible reservoir further having at least one fastener for cooperating with the at least one fastener mounted from the internal surface of the conical crown, so that the flexible reservoir cooperates with the conical crown in supporting the flexible reservoir from the conical crown, and so that the lower end and the outlet are positioned below the fill neck when the collar or protrusion engages the opening at the top of the generally conical crown, and so that the flexible reservoir may be inserted into the conical crown through the opening at the top of the conical crown and the outlet positioned to coincide with the passage through the interior divider wall.

* * * * *